US007980851B2

(12) United States Patent
Takano et al.

(10) Patent No.: US 7,980,851 B2
(45) Date of Patent: Jul. 19, 2011

(54) HEAT TREATMENT FURNACE AND HEAT TREATMENT FACILITY COMPRISING IT

(75) Inventors: Kazuhide Takano, Okazaki (JP); Shinji Goto, Okazaki (JP)

(73) Assignees: Toyota Jidosha Kabushiki Kaisha, Toyota-shi, Aichi-ken (JP); Nihon Kohnetsu Industrial Co., Ltd., Nagoya, Aichi (JP)

( * ) Notice: Subject to any disclaimer, the term of this patent is extended or adjusted under 35 U.S.C. 154(b) by 608 days.

(21) Appl. No.: 11/795,609

(22) PCT Filed: Jan. 18, 2006

(86) PCT No.: PCT/JP2006/001091

§ 371 (c)(1),
(2), (4) Date: Jul. 19, 2007

(87) PCT Pub. No.: WO2006/078052

PCT Pub. Date: Jul. 27, 2006

(65) Prior Publication Data

US 2008/0003534 A1 Jan. 3, 2008

(30) Foreign Application Priority Data

Jan. 20, 2005 (JP) ..... 2005-013027

(51) Int. Cl.
*F27B 1/10* (2006.01)

(52) U.S. Cl. ..... 432/144; 432/145

(58) Field of Classification Search ..... 266/172; 432/58, 144, 145, 239; 414/152, 153, 180
See application file for complete search history.

(56) References Cited

U.S. PATENT DOCUMENTS

| | | | | |
|---|---|---|---|---|
| 4,591,337 | A * | 5/1986 | Gillhaus | 432/138 |
| 7,210,990 | B2 * | 5/2007 | Buchmann et al. | 451/104 |

FOREIGN PATENT DOCUMENTS

| | | |
|---|---|---|
| JP | 63-177952 | 11/1988 |
| JP | 02-050080 | 2/1990 |
| JP | 05-172464 | 7/1993 |
| JP | 2819292 | 8/1998 |
| JP | 11-156528 | 6/1999 |
| JP | 2003-183725 | 7/2003 |

* cited by examiner

*Primary Examiner* — Gregory A Wilson
(74) *Attorney, Agent, or Firm* — Finnegan, Henderson, Farabow, Garrett & Dunner, LLP

(57) ABSTRACT

With regard to a heat treatment furnace (a solution furnace 1 and an ageing furnace 3), a furnace chamber 15 comprises a furnace body 12 opening downward and a floor body 14 closing the lower opening of the furnace body 12 and rotatably driven, and one or plural stages of mounting shelves 16 on which work pieces 8 are mounted are provided in the furnace chamber 15. Hot-air circulation equipments 20A and 20B circulating hot air in the furnace chamber 15 along the peripheral direction when viewed in plan are provided in the furnace body 12. The mounting shelves 16 are fixed to a prop 17 standingly provided on the floor body 14 and are rotated integrally with the floor body 14.

9 Claims, 10 Drawing Sheets

HEAT TREATMENT FURNACE AND HEAT TREATMENT FACILITY COMPRISING IT

FIELD OF THE ART OF THE INVENTION

The present invention relates to an art of heat treatment of mold goods formed from aluminum alloy or the like by casting, forging or the like. In more detail, the present invention relates to a heat treatment furnace performing solution treatment and ageing treatment, and heat treatment facility comprising the heat treatment furnace.

BACKGROUND ART

Conventionally, there is well known heat treatment facility for castings and forgings of aluminum, steel or the like which performs a series of treatments, solution treatment, quenching treatment and ageing treatment.

For example, with regard to construction of facility shown in FIG. 9, plural work pieces (treated bodies) are housed in a tray 70, and each of the work pieces in the tray 70 is solution-treated, quenched and aged continuously while conveying the tray 70. Such an art concerning heat treatment process using the tray 70 is known.

With regard to the construction shown in FIG. 9, a reference numeral 71 designates a solution furnace, a reference numeral 72 designates a quenching bath, and a reference numeral 73 designates an ageing furnace. These members are supplied thereto with the trays 70 continuously. Conveyors 75 are provided in an underground pit 76 so as to recover core sand adhering to the work pieces. The conveyors 75 convey the core sand to a sand recovery box 77.

The Japanese Patent Laid Open Gazette 2003-183725 discloses construction that a solution furnace and an ageing furnace are rotary furnaces. With regard to this patent literature 1, a fast heat-up furnace is disposed which increases temperature in a short time before the solution treatment in the process of solution treatment, quenching treatment and ageing treatment. This fast heat-up aims to remove internal stress accumulated in the work pieces.

The construction of facility shown in FIG. 9 has below problems.

Firstly, at the time of heat-up in the solution furnace 71 and the ageing furnace 73, temperature distribution is uneven between the work pieces in the tray 70, and long time is required for all the work pieces in the tray 70 to reach to set temperature. As a result, the soaking time of the work piece with short heat-up time is long and the soaking time of the work piece with long heat-up time is short, whereby the quality of the work pieces becomes uneven. That is because the place that hot air cannot reach easily exists in the tray 70 housing the work pieces. For example, the quality of work pieces 78*a* and 78*b* shown in FIG. 10 is uneven.

At the time of cooling in the quenching bath 72, the cooling rate of the work pieces 78*a* and 78*b* is also uneven.

At the heat-up process and cooling process, heat energy moves concerning the heat-up and cooling of the trays 70, whereby the energy for the heat-up and cooling of the work pieces losses. Accordingly, the line of the solution furnace 71 and the ageing furnace 73 is extended and the output of burner is raised.

It is necessary to load the trays 70 to the facility and to take out the trays 70 from the facility.

It is conceivable to provide a fast heat-up zone at which the temperature is higher than the soaking temperature so as to shorten the heat-up time. However, because of the above-mentioned unevenness of the heat, some work pieces may be heated higher than the melting point.

The temperature in the solution furnace 71 or the ageing furnace 73 is fallen at the time that the tray 70 is conveyed into the furnace. That also causes the loss of energy and extends the heat-up time.

Since the tray 70 is cooled and heated repetitively, the tray 70 may be strained, whereby the tray 70 may be caught on a conveying way so as to stop the line. Furthermore, the maintenance cost of the tray 70 is required.

For recovering core sand, screws provided in chutes 79 so as to discharge the core sand on the conveyors 75, whereby a driving source for the screws is required. Furthermore, the screws are worn out by the core sand, thereby increasing the maintenance cost for repair or exchange.

Sand may fall at the connection point of the conveyors 75. For solving this problem, it may be constructed so that the conveyors 75 are omitted and the sand recovery box 77 is provided below each of the chutes 79. However, this construction increases the load for recovering the sand, thereby increasing the maintenance cost (labor cost).

The facility is constructed to convey the plural trays 70 therein, whereby the facility is large and number of actuators and the like of burners 81, fans 82 and conveying equipments 83 is increased. Accordingly, the execution cost is increased, the execution period is extended, and the maintenance cost is increased. Furthermore, the facility cannot be transferred and diverted easily.

SUMMARY OF THE INVENTION

With regard to the art disclosed in the above-mentioned patent literature, a fast heat-up furnace is required to be disposed, that is, the cost for disposing the fast heat-up furnace is required. By improving the efficiency of heat-up of the solution furnace, the same effect can be obtained without disposing the fast heat-up furnace.

In consideration of the above-mentioned problems, the present invention provides a heat treatment furnace of new construction and a heat treatment facility comprising the heat treatment furnace.

The above-mentioned problems are solved by the following means according to the present invention.

According to the present invention, with regard to a heat treatment furnace, a furnace chamber comprises a furnace body opening downward and a floor body closing the lower opening of the furnace body, and one or plural stages of mounting shelves on which a work piece is mounted are provided in the furnace chamber, and an intake port and an exhaust port provided in perimeter of the furnace body for exhaust hot-air horizontally. Accordingly, compared with the conventional facility using trays, this construction does not use any tray so as to equalize the quality of each of the work pieces and to improve the quality of the work pieces. The loss of energy caused by heat-up and cooling of the trays is curtailed. The contact area of each of the work pieces and hot air is secured widely so as to reduce the heat-up time, thereby reducing the time for whole heat treatment including the soaking time. Plural stages of the mounting shelves are provided so as to heat-treat many work pieces rapidly, thereby improving the throughput.

According to the present invention, with regard to a heat treatment furnace, a heat treatment furnace whose furnace chamber comprises a furnace body opening downward and a floor body closing the lower opening of the furnace body, one or plural stages of mounting shelves on which a work piece is mounted are provided in the furnace chamber; a hot-air circulation equipment, which circulates hot air in the furnace chamber along peripheral direction when viewed in plan, is provided in the furnace chamber. Accordingly, the amount of heat air (energy) supplied to each of the mounting shelves is equalized and each of the work pieces is heat-treated uniformly, thereby equalizing the product quality of the work pieces. Falling sand is not blown up so that the life expectancy of the equipment is extended.

According to the present invention, with regard to a heat treatment furnace, a furnace chamber of the heat treatment furnace comprises a furnace body opening downward and a floor body closing the lower opening of the furnace body, the furnace chamber is divided into upper and lower two spaces by a partition, the upper space is constructed as an ageing furnace performing ageing treatment, the lower space is constructed as a solution furnace performing solution treatment, one or plural stages of mounting shelves on which a work piece is mounted are provided each of the ageing furnace and the solution furnace, and the furnace body is provided therein with a hot-air circulation equipment circulating hot air in the ageing furnace along peripheral direction when viewed in plan and a hot-air circulation equipment circulating hot air in the solution furnace along peripheral direction when viewed in plan. Accordingly, the present invention requires smaller space for installing the heat treatment furnace (the equipment is miniaturized), whereby the space for installing the whole heat treatment facility is reduced.

According to the present invention, the floor body is rotatively driven, and the mounting shelf is supported by a prop standingly provided on the floor body and is rotated integrally with the floor body. Accordingly, the influence of unevenness of heat transfer amount caused by difference of disposition is reduced, thereby equalizing the product quality of the work pieces.

According to the present invention, the floor body is provided therein with a chute part communicated with outer space below the floor body and a sand discharge mechanism having a lid opening and closing lower opening of the chute part, and a guide member opening and closing the lid and a sand recovery box into which sand accumulated on the lid is thrown at the time that the lid is opened are provided below the floor body. Accordingly, the equipment recovering sand is easy and cheap. Also, sand can be recovered easily.

According to the present invention, the heat treatment furnace comprises a solution furnace and an ageing furnace, and heat treatment facility comprises the solution furnace and the ageing furnace. Accordingly, compared with the heat treatment furnace of the conventional construction, the time for finishing the solution treatment by the solution furnace and the ageing treatment by the ageing furnace is shortened, whereby all processes of the heat treatment are finished for a short time. Compared with the conventional facility using trays, the execution cost is reduced, the execution period is shortened, and the maintenance cost is reduced. The solution furnace and the ageing furnace are constructed individually so that the facility can be transferred and diverted easily. The number of the burner and fan is reduced and the conveying equipment for the trays is not necessary.

According to the present invention, the heat treatment facility comprises the solution furnace heat-treating work pieces, a quenching bath quenching the work pieces solution-treated by the solution furnace, the ageing furnace ageing the work pieces quenched by the quenching bath, an air cooling equipment cooling the work pieces aged by the ageing furnace, a work piece take-in equipment taking in the work pieces to be solution-treated by the solution furnace, a work piece take-out equipment taking out the work pieces cooled by the air cooling equipment, and a robot arm moving the work pieces one by one to the work piece take-in equipment, the solution furnace, the quenching bath, the ageing furnace, the air cooling equipment and the work piece take-out equipment in this order. Accordingly, work pieces complicated shaped and work pieces with core sand, which cannot be conveyed by a conveyor or the like, also can be conveyed by the robot arm. The quenching bath cools the work pieces one by one so that the quenching bath can be constructed compactly. The work pieces after heat-treated are cooled compulsorily by the air cooling equipment so that the work pieces can be checked easily by hand at the later process.

THE BEST MODE OF EMBODIMENT OF THE INVENTION

The mode for carrying out the invention is explained on the basis of attached drawings.

Embodiment 1

Figure 1:
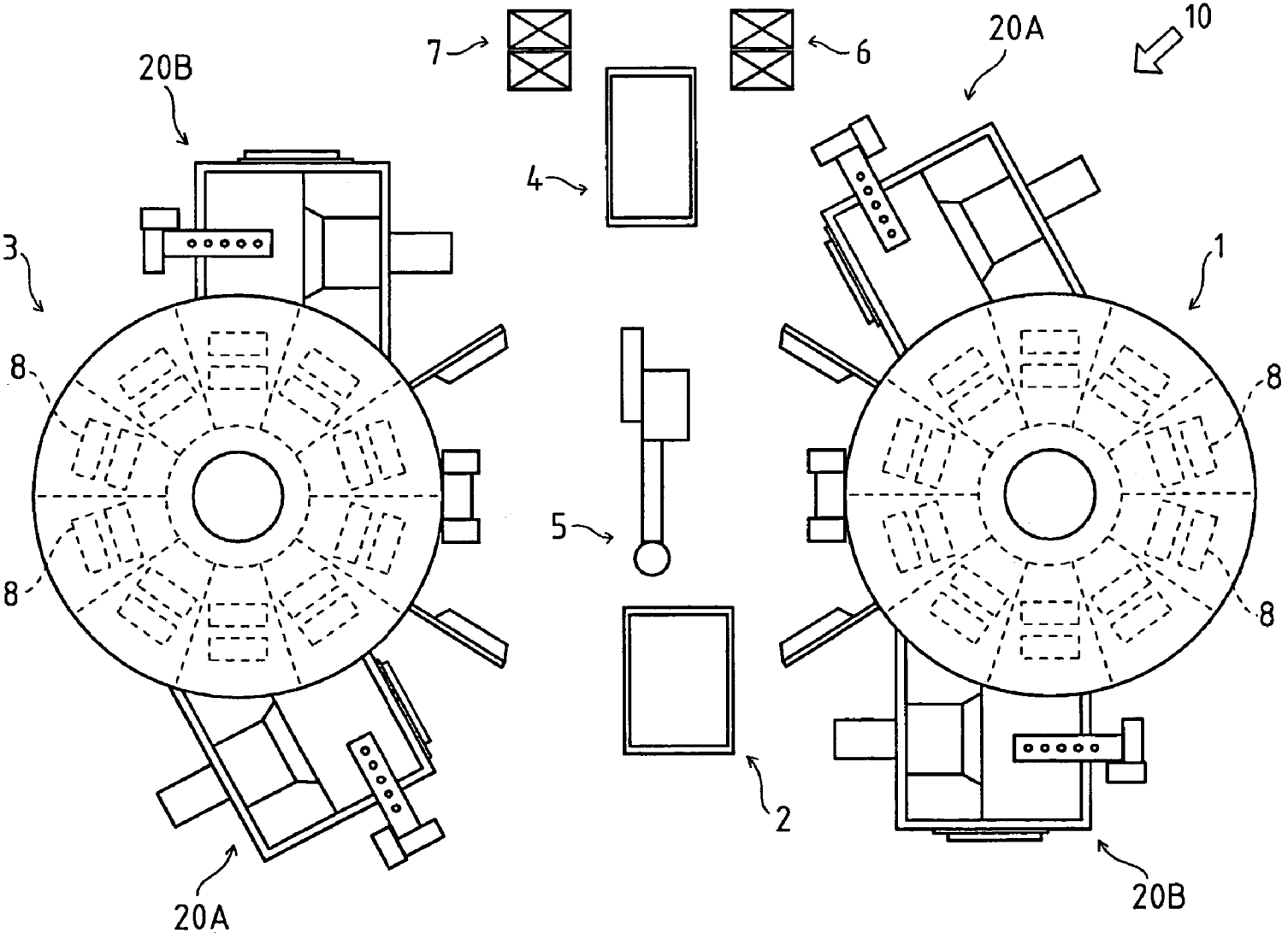
FIG. 1 is a drawing of heat treatment equipment according to the present invention.

As shown in FIG. 1, heat treatment facility 10 comprises a solution furnace 1, a quenching bath 2, an ageing furnace 3, an air cooling equipment 4, a robot arm 5, a work piece take-in equipment 6, and a work piece take-out equipment 7. With regard to this construction of equipments, work pieces 8 taken in by the work piece take-in equipment 6 is solution-processed by the solution furnace 1, quenched by the quenching bath 2, aged by the ageing furnace 3, and cooled by the air cooling equipment 4 in this order, and then taken out by the work piece take-out equipment 7.

The solution furnace 1 and the ageing furnace 3 are constituted by a heat treatment furnace according to the present invention. With regard to below construction of the heat treatment furnace, one of solution treatment and ageing treatment can be performed alternatively by setting temperature and time of heat treatment.

Figure 2:
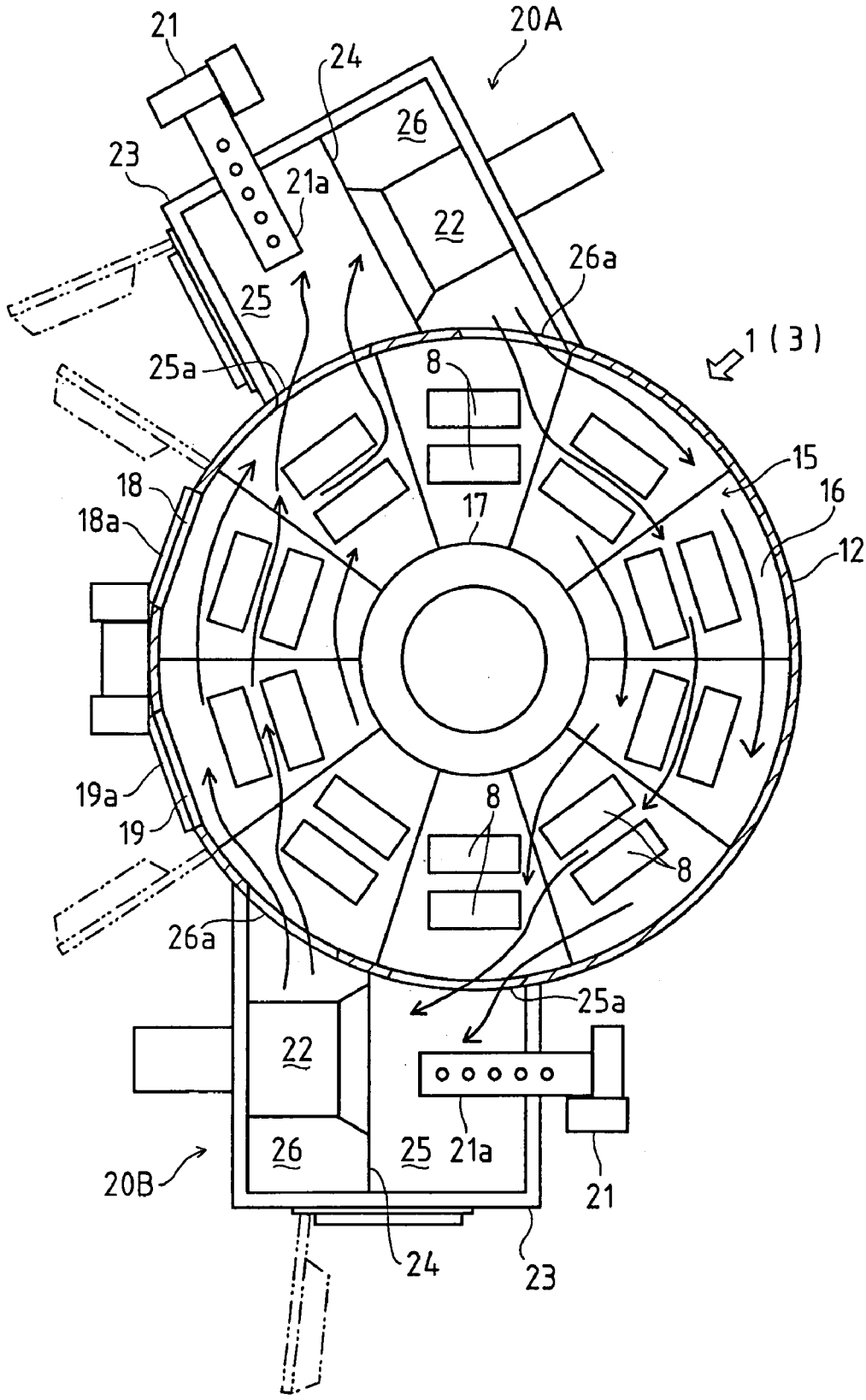
FIG. 2 is a sectional plan view of a heat treatment furnace of the embodiment 1.
Figure 3:
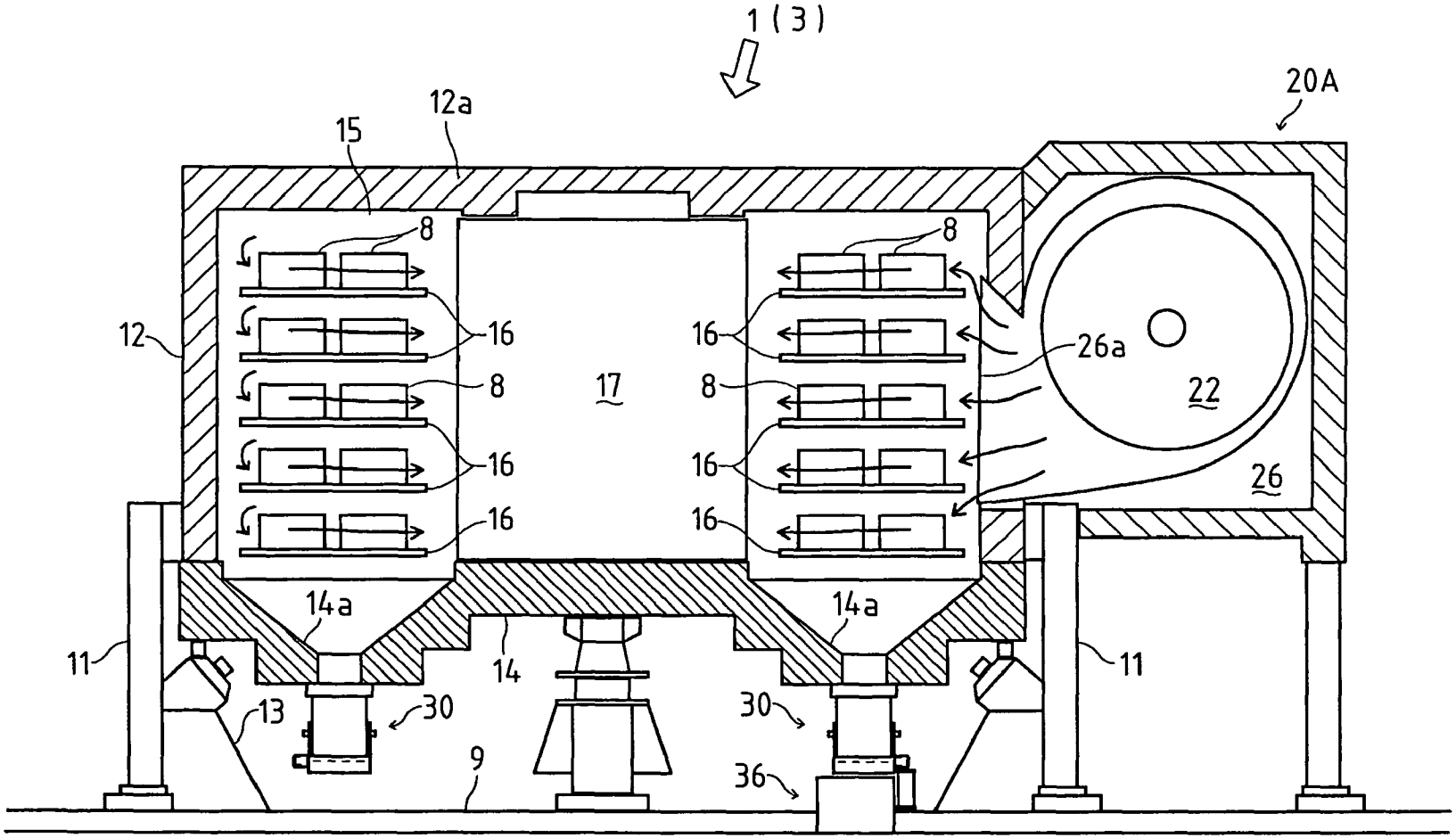
FIG. 3 is a sectional side view of the heat treatment furnace of the embodiment 1.

As shown in FIGS. 2 and 3, the heat treatment furnace according to the present invention (the solution furnace 1 and the ageing furnace 3) is supported by a base 11. A furnace chamber 15 comprises a cylindrical furnace body 12 opening downward and a floor body 14 closing the lower opening of the furnace body 12 and rotatably supported by a base 13.

Plural stages of mounting shelves 16 are provided in the furnace chamber 15. The upper side of the furnace body 12 is closed by an upper wall 12*a*.

The mounting shelves 16 are fixed to a prop 17 vertically standingly provided at the center of the floor body 14, and each of the stages is disk-like shaped centering on the prop 17. In this embodiment, 20 pieces of the work pieces 8 can be mounted on each of the stages.

The floor body 14 is rotated centering on the axis of the prop 17 by a motor (not shown). By the rotation of the floor body 14, the prop 17 and the mounting shelves 16 are rotated. In addition, the number of the stages of the mounting shelves 16 is designed suitably. For example, the equipment construction treating few work pieces 8 may have one stage.

An inlet 18 through which the work pieces 8 are taken in the mounting shelves 16 and an outlet 19 which the work pieces 8 are taken out from the mounting shelves 16 are provided in the furnace body 12. Open-close doors 18*a* and 19*a* are provided at the inlet 18 and the outlet 19 respectively and opened and closed as required.

At the two parts of the outer perimeter of the furnace body 12, hot-air circulation equipments 20A and 20B, each of them has a burner 21 and a fan 22, are provided. In this embodiment, the two hot-air circulation equipments 20A and 20B are disposed at the positions substantially distant of 180 degrees along the peripheral direction.

Each of the hot-air circulation equipments 20A and 20B is constructed by disposing the burner 21 and the fan 22 in a casing 23 arranged on the outer perimeter of the furnace body 1. The inside of the casing 23 is divided into two chambers, a burner chamber 25 and a fan chamber 26 by a partition 24. A heating part 21*a* of the burner 21 is disposed in the burner chamber 25, and the fan 22 is disposed in the fan chamber 26. The burner chamber 25 and the fan chamber 26 are communicated with the inside of the furnace chamber 15 respectively through openings 25*a* and 26*a* provided in the furnace body 12. With regard to the fan 22, an intake port of the fan 22 is opened in the partition 24 and an exhaust port of the fan 22 is provided at the side of the fan chamber 26. Air in the burner chamber 25 heated by the burner 21 is sucked by the rotation of the fan 22 and discharged through the inside of the fan chamber 26 and the opening 26*a* to the inside of the furnace chamber 15. Hot air discharged from the hot-air circulation equipment 20A is guided into the burner chamber 25 of the hot-air circulation equipment 20B by the suction force of the fan 22 of the hot-air circulation equipment 20B and heated by the burner 21, and then discharged by the fan 22 of the hot-air circulation equipment 20B and returned to the hot-air circulation equipment 20A again. Accordingly, hot air is circulated in the furnace chamber 15.

As shown in FIG. 3, the opening 26*a* is set its vertical dimension so as to face the work pieces 8 mounted on the highest and lowest mounting shelves 16, whereby hot air is sent to each of the mounting shelves 16 horizontally. As shown in FIG. 2, the hot air sent to each of the mounting shelves 16 is circulated in the furnace chamber 15 while passing through spaces between the work pieces 8. By sending the hot air to each of the mounting shelves 16, the amount of heat air (energy) supplied to each of the mounting shelves 16 is equalized and each of the work pieces 8 is heat-treated uniformly, thereby equalizing the product quality of the work pieces 8. The contact area of each of the work pieces 8 and hot air is secured widely so that the temperature distribution of each of the work pieces 8 is equalized, thereby improving the product quality of the work pieces 8. Heat is transferred from heat air to each of the work pieces 8 efficiently, thereby reducing heat-up time.

Figure 4:
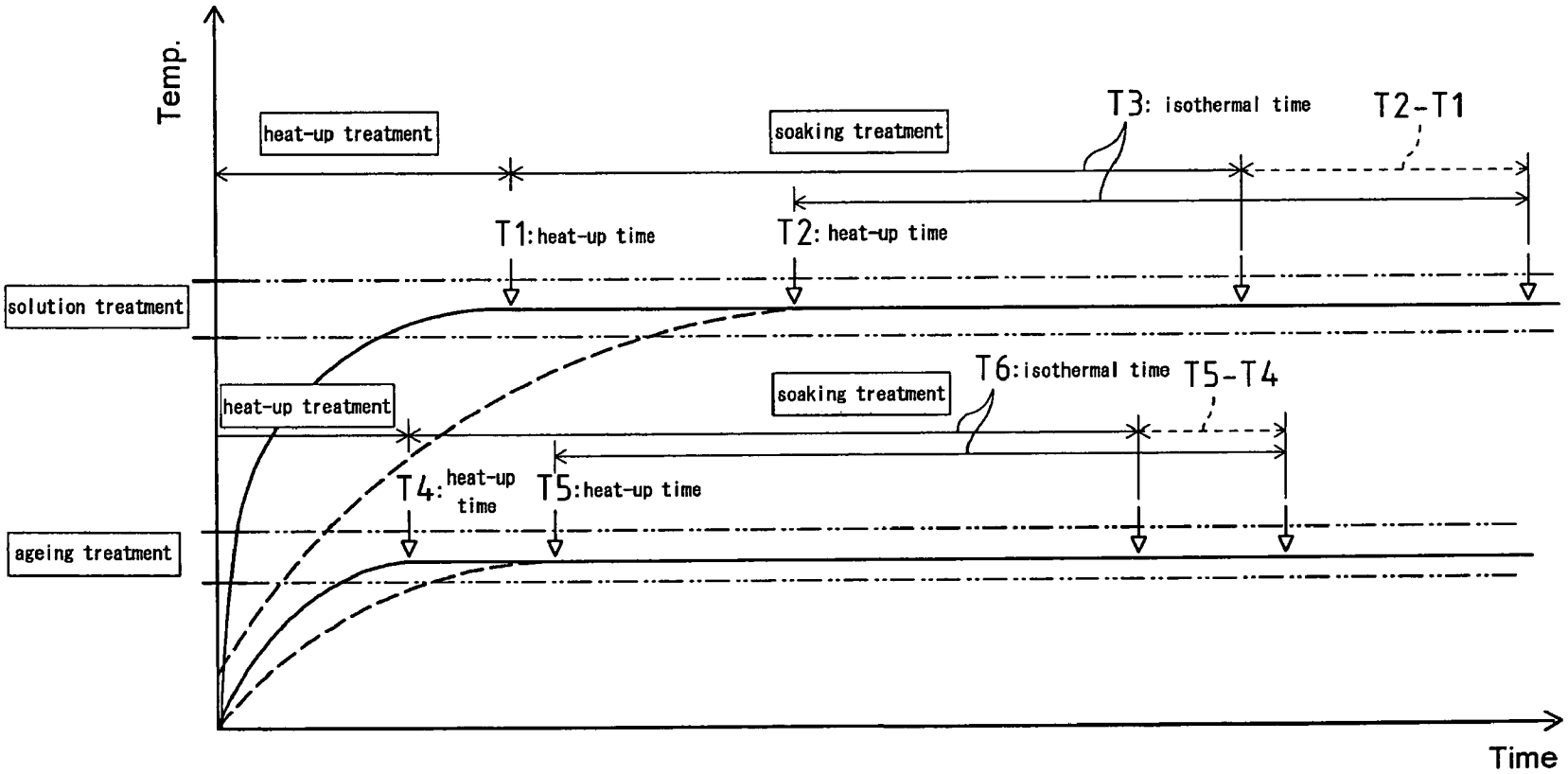
FIG. 4 is a diagram of time shortening of solution treatment and ageing treatment.

FIG. 4 shows the shortening of the heat-up time. Though the facility using trays described in the background art requires heat-up time T2 for the solution treatment, the construction according to the present invention requires heat-up time T1. In the case that soaking time T3 is required, the time necessary for the whole solution treatment can be reduced for the difference of the heat-up time T2 and the heat-up time T1 (T2−T1). In addition, in FIG. 4, the heat treatment furnace according to the present invention is used as the ageing furnace 3, and heat-up time T4 and soaking time T6 are shown. Though the facility using trays described in the background art requires heat-up time T5 for the solution treatment, the construction according to the present invention requires heat-up time T4, and the time necessary for the whole solution treatment can be reduced for the difference of the heat-up time T5 and the heat-up time T4 (T5−T4).

With regard to the above-mentioned mode of heat air circulation, heat air is not convected in vertical direction. Accordingly, core sand falling from the work pieces 8 is not blown up, and falls down and is guided to chute parts 14*a* formed in the floor body 14. If core sand is blown up, the core sand collides with the inner wall of the furnace body 12 so that the inner wall surface may be abraded and damaged or the burner 21 may be damaged. However, with regard to the construction according to the present invention, such a problem does not occur, whereby the life expectancy of the equipment is extended.

As shown in FIG. 3, the chute parts 14*a* each of which is substantially Y-like shaped in section are provided at plural positions of the floor body 14 centering on the axis of the prop 17. In this embodiment, ten chute parts 14*a* are provided, and each of the chute parts 14*a* is arranged below the work pieces 8. A sand discharge mechanism 30 is provided at the lower opening of each of the chute parts 14*a*.

Figure 5:
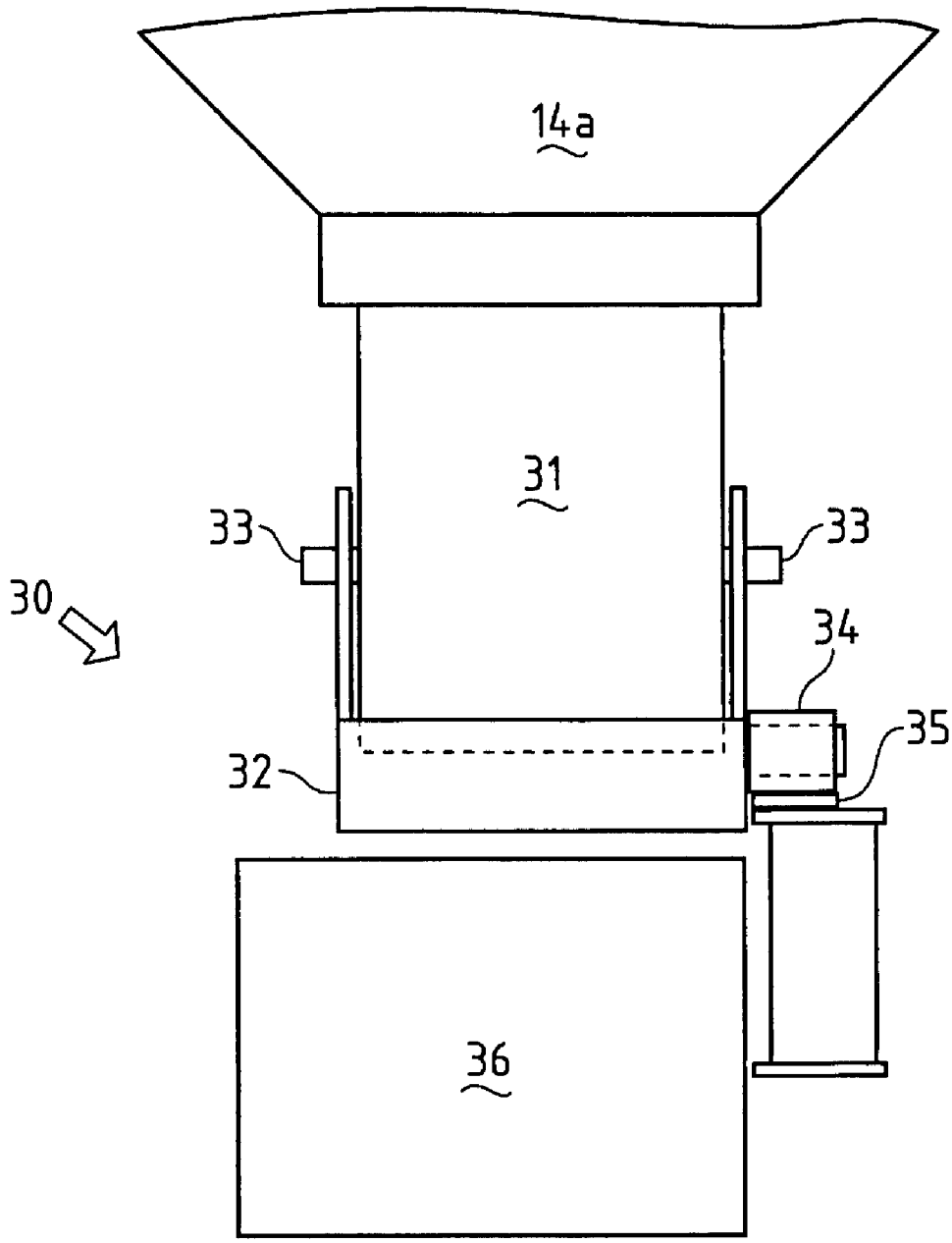
FIG. 5 is a drawing of a sand discharge mechanism.
Figure 6:
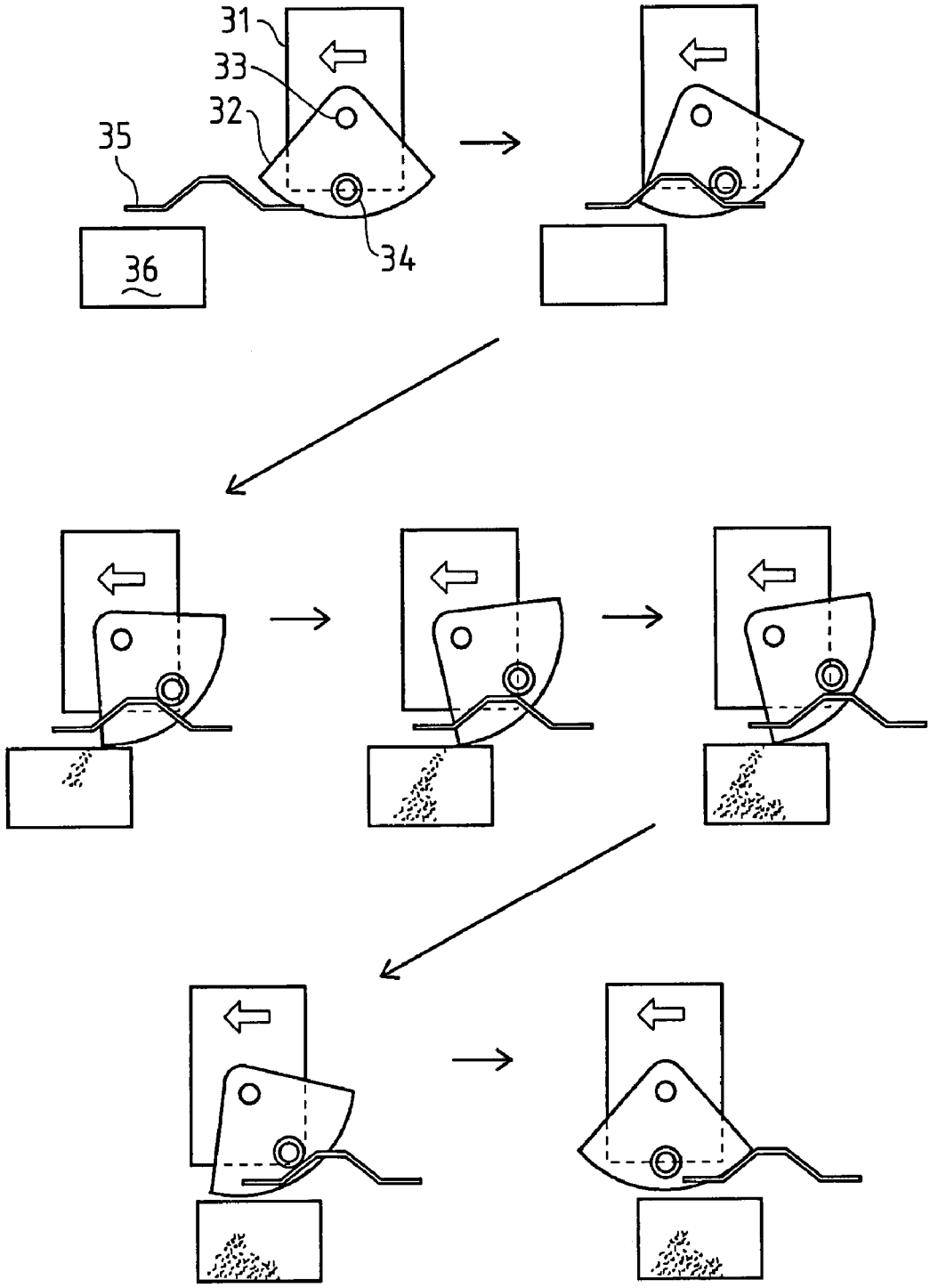
FIG. 6 is a drawing of discharge of sand to a sand recovery box.

As shown in FIG. 5, the sand discharge mechanism 30 is constructed so that a cylinder 31 substantially quadratic when viewed in section supports a lid 32, which is cradle-like shaped and covers the lower opening of the cylinder 31, rockably by support shafts 33. A projection 34 projectingly provided at the side of the lid 32 touches a guide member 35 fixed to a side of an equipment installation floor surface 9 so as to rock the lid 32. A sand recovery box 36 is arranged at the position at which sand accumulated on the lid 32 falls down by rocking the lid 32. In this embodiment, as shown in FIG. 6, the guide member 35 is a cam cone-shaped when viewed in side. By touching the projection 34 to the cam, the lid 32 is simply opened and closed following the rotation of the floor body 14 (the movement of the sand discharge mechanism 30).

According to the above-mentioned construction, as shown in FIG. 6, when each of the sand discharge mechanisms 30 reaches the position at which the guide member 35 is arranged, the lid 32 is opened and sand accumulated on the lid 32 is thrown into the sand recovery box 36. Accordingly, the sand is recovered into the sand recovery box 36. All the sand discharge mechanisms 30 can be dealt with by only one pair of the guide member 35 and the sand recovery box 36. This equipment construction is easy. Since sand is recovered at one position, the efficiency of the sand recovery work treating the sand recovery box 36 is improved. The conventional construction using a screw or the like requires an actuator exclusively for recovering sand. To the contrary, the sand discharge mechanism 30 can open and close the lid 32 by the rotation of the floor body 14 without any exclusive actuator, thereby saving the cost of equipment.

The construction of the heat treatment furnace according to the present invention is explained above. The construction is also adopted to the solution furnace 1 and the ageing furnace 3. With regard to the heat treatment furnace, the furnace chamber 15 comprises the furnace body 12 opening downward and the floor body 14 closing the lower opening of the furnace body 12 and rotatably driven, and one or plural stages of the mounting shelves 16 on which the work pieces 8 are mounted are provided in the furnace chamber 15. Compared with the conventional facility using trays, this construction does not use any tray so as to equalize the quality of each of the work pieces 8 and to improve the quality of the work pieces 8. The loss of energy caused by heat-up and cooling of the trays is curtailed.

The contact area of each of the work pieces 8 and hot air is secured widely so as to reduce the heat-up time, thereby reducing the time for whole heat treatment including the soaking time. Plural stages of the mounting shelves 16 are provided so as to heat-treat many work pieces 8 rapidly, thereby improving the throughput.

The hot-air circulation equipments 20A and 20B circulating hot air in the furnace chamber 15 along the peripheral direction when viewed in plan are provided in the furnace body 12. Accordingly, the amount of heat air (energy) supplied to each of the mounting shelves 16 is equalized and each of the work pieces 8 is heat-treated uniformly, thereby equalizing the product quality of the work pieces 8. Falling sand is not blown up so that the life expectancy of the equipment is extended. Compared with the conventional facility using trays, the loss of energy caused by heating and cooling of the trays does not occur, whereby burner and fan with low capacity can be adopted.

The mounting shelves 16 are fixed to the prop 17 standingly provided on the floor body 14 and are rotated integrally with the floor body 14. Accordingly, the influence of unevenness of heat transfer amount caused by difference of disposition is reduced, thereby equalizing the product quality of the work pieces 8. In addition, with regard to the equipment construction that the number of the mounted the work pieces 8 is small, the floor body 14 is not necessary to be rotated.

The floor body 14 is provided therein with the chute parts 14*a* communicated with the outer space below the floor body 14 and the sand discharge mechanisms 30 having the lids 32 opening and closing the lower openings of the chute parts 14*a*. Below the floor body 14, the guide member 35 touching the lid 32 so as to open and close the lid 32 and the sand recovery box 36 into which sand accumulated on the lid 32 is thrown at the time of opening the lid 32 are provided. Accordingly, the equipment recovering sand is easy and cheap. Also, sand can be recovered easily.

The heat treatment furnace constructed as the above is used as the solution furnace 1 and the ageing furnace 3 so that the heat treatment facility 10 comprises the solution furnace 1 and the ageing furnace 3. The heat treatment facility 10 comprises the solution furnace 1 solution-treating the work pieces 8, the quenching bath 2 quenching the work pieces 8 solution-treated by the solution furnace 1, the ageing furnace 3 ageing the work pieces 8 quenched by the quenching bath 2, the air cooling equipment 4 cooling the work pieces 8 aged by the ageing furnace 3, the work piece take-in equipment 6 taking in the work pieces 8 to be solution-treated by the solution furnace 1, the work piece take-out equipment 7 taking out the work pieces 8 cooled by the air cooling equipment 4, and the robot arm 5 moving the work pieces 8 one by one to the work piece take-in equipment 6, the solution furnace 1, the quenching bath 2, the ageing furnace 3, the air cooling equipment 4 and the work piece take-out equipment 7 in this order.

With regard to the construction of the heat treatment facility 10, the work pieces 8 are moved between the equipments by the robot arm 5 one by one, whereby work pieces complicated shaped and work pieces with core sand, which cannot be conveyed by a conveyor or the like, also can be conveyed. Compared with the heat treatment furnace of the conventional construction, the time for finishing the solution treatment by the solution furnace 1 and the ageing treatment by the ageing furnace 3 is shortened, whereby all processes of the heat treatment are finished for a short time. Compared with the conventional facility using trays, the execution cost is reduced, the execution period is shortened, and the maintenance cost is reduced. The solution furnace 1 and the ageing furnace 3 are constructed individually so that the facility can be transferred and diverted easily. The number of the burner and fan is reduced and the conveying equipment for the trays is not necessary, whereby the equipments is constructed cheaply and compactly. The quenching bath 2 cools the work pieces 8 one by one so that the quenching bath 2 can be constructed compactly. The work pieces after heat-treated are cooled compulsorily by the air cooling equipment 4 so that the work pieces can be checked easily by hand at the later process. The work pieces are conveyed to the air cooling equipment 4 and cooled one by one so that many work pieces are not cooled simultaneously, whereby the work pieces are cooled uniformly to the set temperature. Any tray is not used so that loss of energy is not caused for cooling the tray. It is not necessary to stock the work pieces for natural cooling.

Embodiment 2

Figure 7:
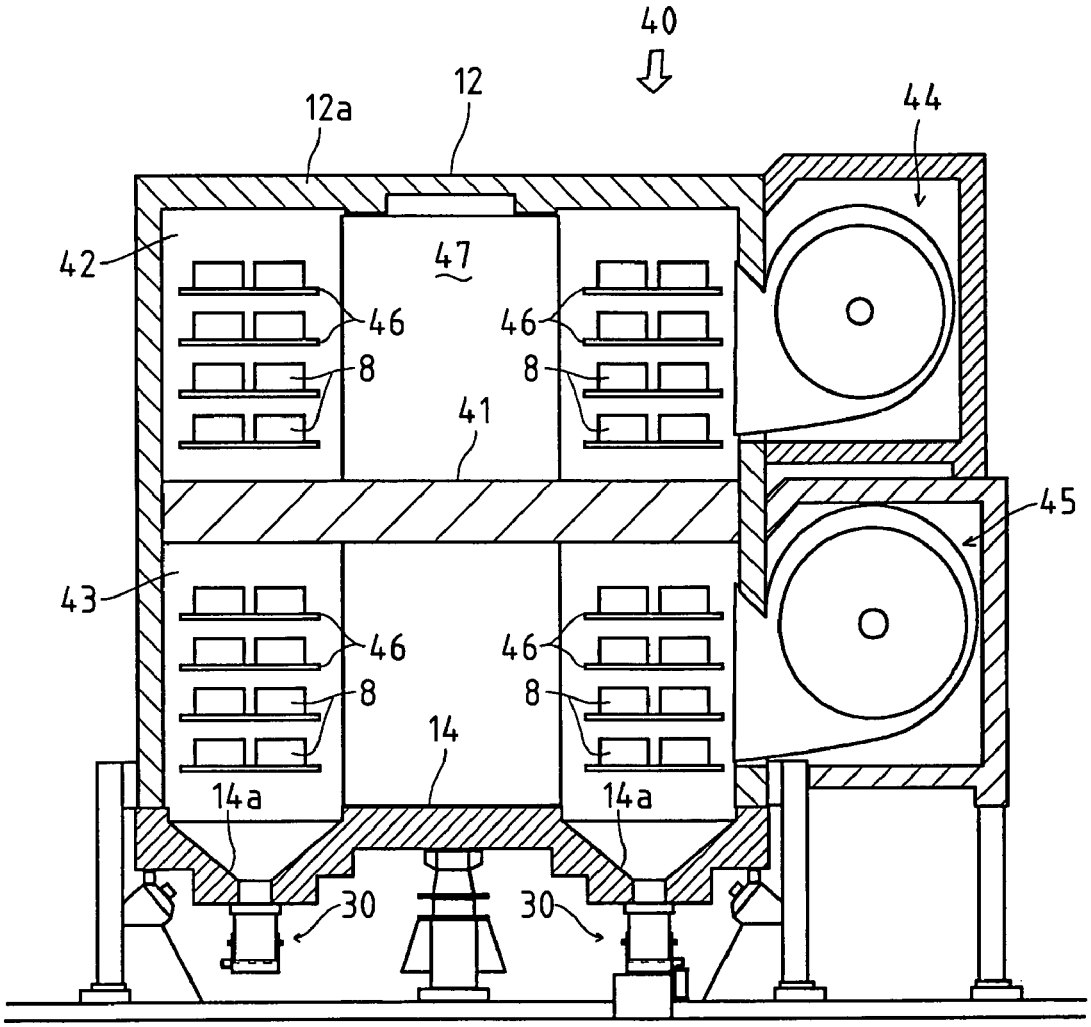
FIG. 7 is a sectional side view of a heat treatment furnace of the embodiment 2.

As shown in FIG. 7, with regard to a heat treatment furnace 40 in this embodiment 2, the furnace chamber 15 of the furnace body 12 is divided into upper and lower two spaces by a partition 41 provided horizontally. The upper space is constructed as an ageing furnace chamber 42 for the ageing treatment, and the lower space is constructed as a solution furnace chamber 43 for the solution treatment. One or plural stages of mounting shelves 46 are provided in each of the ageing furnace chamber 42 and the solution furnace chamber 43. The furnace body 12 comprises a hot-air circulation equipment 44 circulating hot air in the ageing furnace chamber 42 along the peripheral direction when viewed in plan and comprises a hot-air circulation equipment 45 circulating hot air in the solution furnace chamber 43 along the peripheral direction when viewed in plan.

In this construction, the solution furnace chamber 43 is disposed below the ageing furnace chamber 42. That is because core sand adhering to the work pieces 8 tends to fall down at higher temperature. The solution treatment performed at higher temperature than the ageing treatment is performed at the lower side of the furnace body 12 so that the falling core sand is guided efficiently to the chute parts 14*a* of the floor body 14 and recovered.

Heat insulating material is provided inside the partition 41 so as to intercept heat transmission between the ageing furnace chamber 42 and the solution furnace chamber 43 moderately. The heat transmission is not intercepted perfectly so that when the solution treatment preceding to the ageing treatment is performed, the heat of the solution furnace chamber 43 is transmitted to the ageing furnace chamber 42 and the temperature in the ageing furnace chamber 42 raises, whereby the warm-up time of the ageing furnace chamber 42 is shortened. In addition, a prop 47 is provided so as to penetrate the partition 41 vertically and supports mounting shelves 46, whereby the mounting shelves 46 are rotated integrally with the prop 47.

Figure 8:
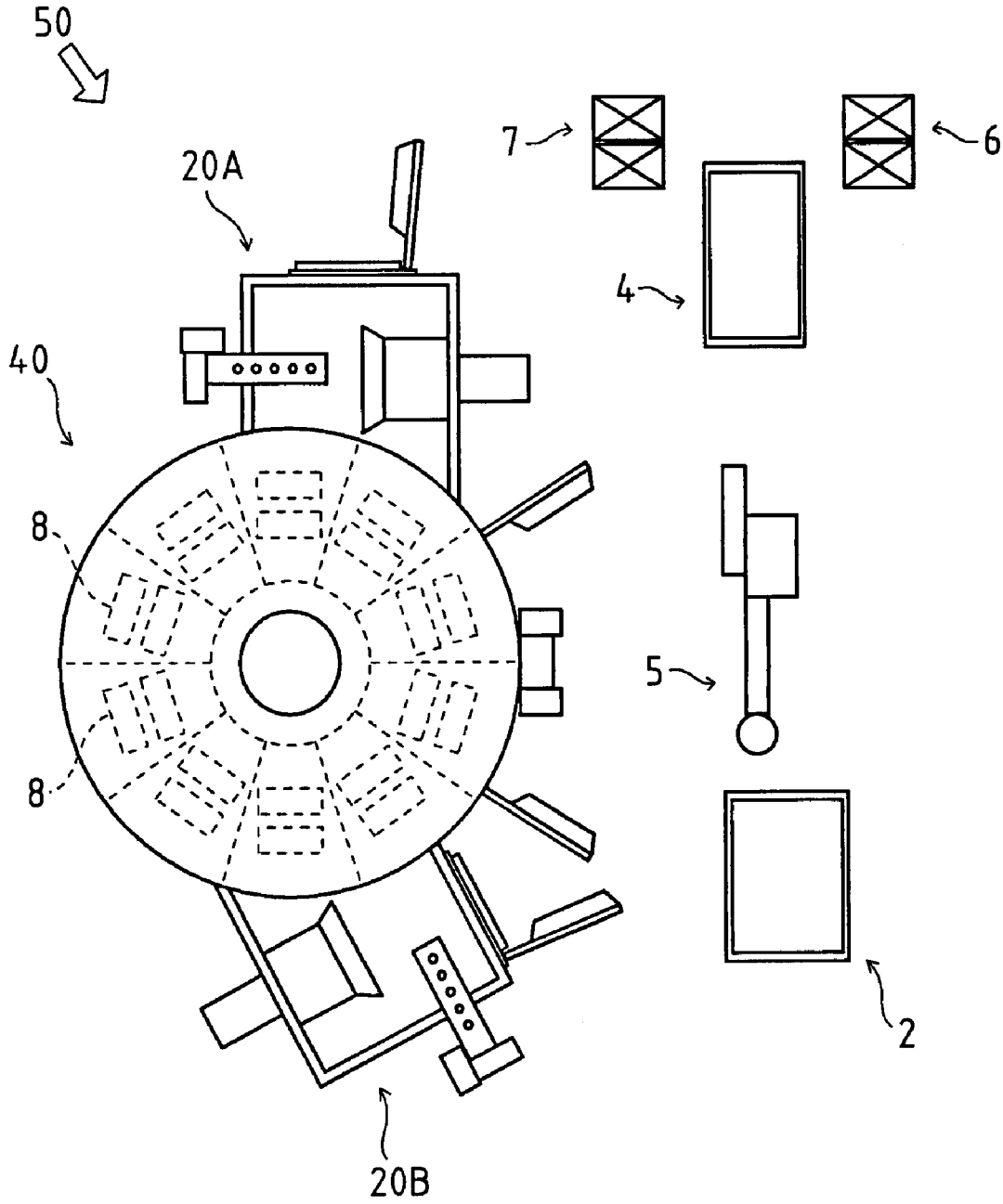
FIG. 8 is a drawing of heat treatment equipment comprising the heat treatment furnace of the embodiment 2.
Figure 9:
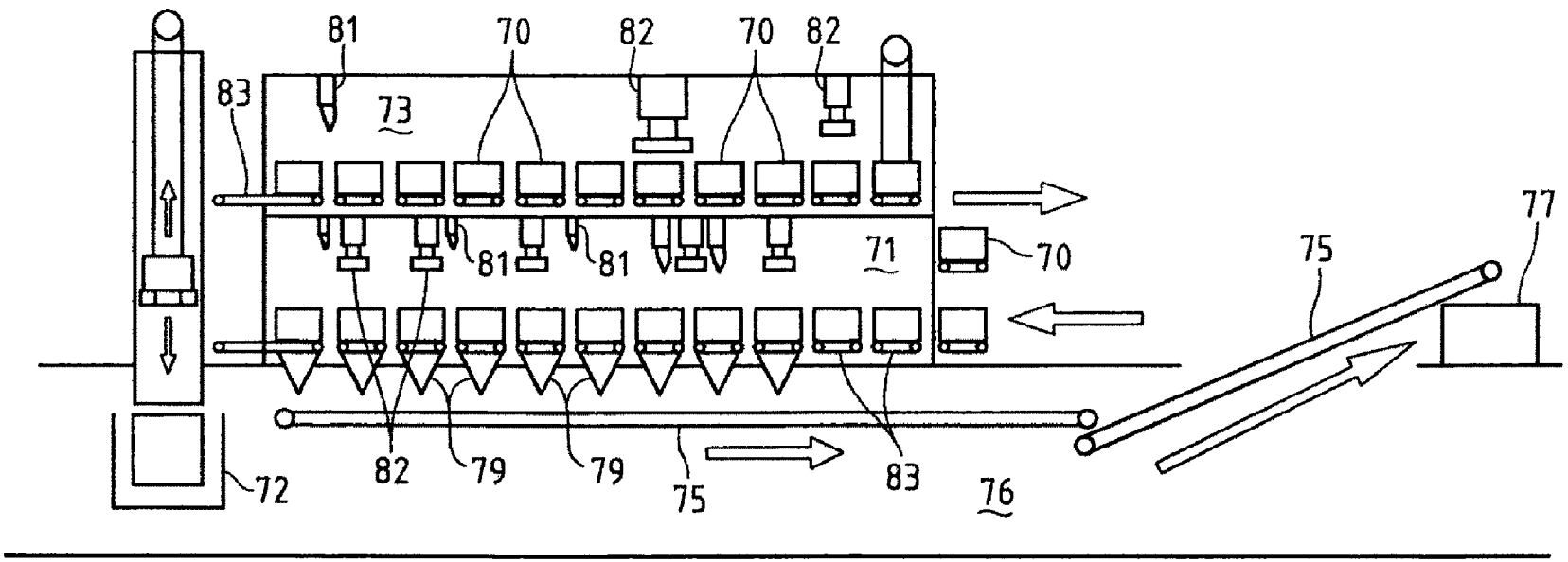
FIG. 9 Prior Art
FIG. 9 is a drawing of heat treatment equipment using trays.
Figure 10:
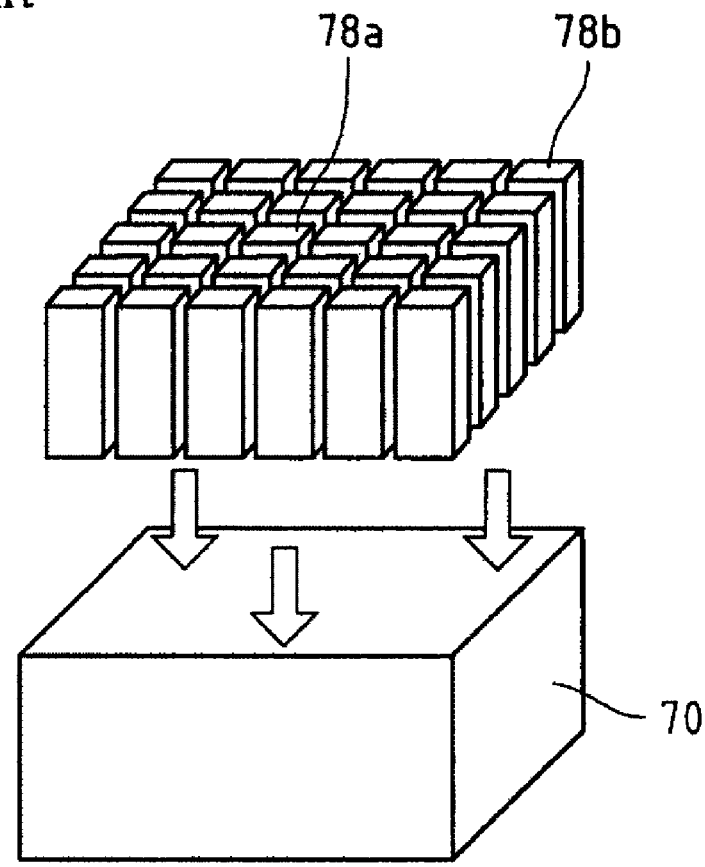
FIG. 10 Prior Art
FIG. 10 is a drawing of the tray and work pieces housed therein.

By adopting the construction of the heat treatment furnace 40 in the embodiment 2, heat treatment facility 50 is constructed as shown in FIG. 8. Compared with the construction shown in FIG. 1, this construction requires smaller space for installing the heat treatment furnace 40 (the equipment is miniaturized), whereby the space for installing the whole heat treatment facility 50 is reduced.

POSSIBILITY OF THE INDUSTRIAL UTILIZATION

The present invention can be used for an art of heat treatment of mold goods formed from aluminum alloy or the like by casting, forging or the like.

The invention claimed is:

1. A heat treatment furnace having a furnace chamber comprising:

a furnace body having a lower opening; and a floor body closing the lower opening of the furnace body, wherein:

one or plural stages of mounting shelves on which a work piece is mounted are provided in the furnace chamber;

an intake port and an exhaust port are provided in a perimeter of the furnace body to intake and exhaust hot-air;

the intake port and the exhaust port are arranged such that the hot-air flows in the horizontal direction in the furnace body; and the floor body is provided therein with a chute part communicated with outer space below the floor body, and a sand discharge mechanism having a lid for opening and closing a lower opening of the chute part.

2. The heat treatment furnace as set forth in claim 1, wherein hot-air circulation equipment, which circulates hot air in the furnace chamber along a peripheral direction when viewed in plan, is provided in the furnace.

3. A heat treatment furnace, comprising:

a furnace chamber of the heat treatment furnace, the furnace chamber comprising:

a furnace body having a lower opening; and a floor body closing the lower opening of the furnace body, wherein the furnace chamber is divided into an upper space and a lower space by a partition;

wherein the upper space is constructed as an ageing furnace performing an ageing treatment;

wherein the lower space is constructed as a solution furnace performing a solution treatment;

wherein one or plural stages of mounting shelves on which a work piece is mounted are provided in each of the ageing furnace and the solution furnace;

wherein an intake port and an exhaust port are provided in a perimeter of the furnace body to intake and exhaust hot-air;

wherein the intake port and the exhaust port are arranged such that the hot-air flows in the horizontal direction in the body;

wherein the floor body is provided therein with a chute part communicated with outer space below the floor body, and a sand discharge mechanism having a lid for opening and closing a lower opening of the chute part; and wherein the furnace body further comprises:

a hot-air circulation equipment circulating hot air in the ageing furnace along a peripheral direction when viewed in plan, and a hot-air circulating equipment circulating hot air in the solution furnace along the peripheral direction when viewed in plan.

4. The heat treatment furnace as set forth in one of claims 1 to 3, wherein the floor body is rotatively driven, and the mounting shelf is supported by a prop standingly provided on the floor body and rotated integrally with the floor body.

5. Heat treatment facility comprising:

the heat treatment furnace as set forth in claim 4, wherein the heat treatment furnace further comprises a solution furnace and an ageing furnace; and the heat treatment facility comprises the solution furnace and the ageing furnace.

6. The heat treatment furnace as set forth in one of claims 1 to 3, wherein:

the furnace further comprises a guide member for opening and closing the lid and a sand recovery box into which sand accumulated on the lid is thrown at the time that the lid is opened, the guide member and the sand recovery box being provided below the floor body.

7. Heat treatment facility comprising:

the heat treatment furnace as set forth in claim 6, wherein the heat treatment furnace further comprises a solution furnace and an ageing furnace; and the heat treatment facility comprises the solution furnace and the ageing furnace.

8. Heat treatment facility comprising:

a heat treatment furnace having a furnace chamber comprising:

a furnace body having a lower opening; and a floor body closing the lower opening of the furnace body, wherein:

one or plural stages of mounting shelves on which a work piece is mounted are provided in the furnace chamber;

an intake port and an exhaust port are provided in a perimeter of the furnace body to intake and exhaust hot-air; and the intake port and the exhaust port are arranged such that the hot-air flows in the horizontal direction in the furnace body;

wherein the heat treatment furnace further comprises a solution furnace and an ageing furnace; and the heat treatment facility comprises the solution furnace and the ageing furnace.

9. The heat treatment facility as set forth in claim 8, further comprising:

the solution furnace heat-treating work pieces;

a quenching bath quenching the work pieces solution-treated by the solution furnace;

the ageing furnace ageing the work pieces quenched by the quenching bath;

an air cooling equipment cooling the work pieces aged by the ageing furnace;

a work piece take-in equipment taking in the work pieces to be solution-treated by the solution furnace;

a work piece take-out equipment taking out the work pieces cooled by the air cooling equipment; and a robot arm moving the work pieces one by one to the work piece take-in equipment, the solution furnace, the quenching bath, the ageing furnace, the air cooling equipment and the work piece take-out equipment in this order.

* * * * *

UNITED STATES PATENT AND TRADEMARK OFFICE

CERTIFICATE OF CORRECTION

PATENT NO. : 7,980,851 B2
APPLICATION NO. : 11/795609
DATED : July 19, 2011
INVENTOR(S) : Kazuhide Takano and Shinji Goto
and It is certified that error appears in the above-identified patent and that said Letters Patent is hereby corrected as shown below:

Title page

Item (86), "PCT/JP2006/001091" should read --PCT/JP2006/301091--

Signed and Sealed this
Fourteenth Day of February, 2012

David J. Kappos

David J. Kappos
*Director of the United States Patent and Trademark Office*